US009587642B2

(12) United States Patent
Sinzaki et al.

(10) Patent No.: US 9,587,642 B2
(45) Date of Patent: Mar. 7, 2017

(54) CENTRIFUGAL FAN AND FAN WITH SOUND-MUFFLING BOX HAVING THE CENTRIFUGAL FAN BUILT-IN

(75) Inventors: Kouji Sinzaki, Aichi (JP); Daisuke Inoue, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 642 days.

(21) Appl. No.: 13/989,061

(22) PCT Filed: Oct. 27, 2011

(86) PCT No.: PCT/JP2011/006012

§ 371 (c)(1),
(2), (4) Date: May 23, 2013

(87) PCT Pub. No.: WO2012/070187

PCT Pub. Date: May 31, 2012

(65) Prior Publication Data

US 2013/0243585 A1 Sep. 19, 2013

(30) Foreign Application Priority Data

Nov. 26, 2010 (JP) ..... 2010-263374

(51) Int. Cl.
*F04D 17/08* (2006.01)
*F04D 29/42* (2006.01)
*F04D 29/44* (2006.01)

(52) U.S. Cl.
CPC ..... *F04D 17/08* (2013.01); *F04D 29/4206* (2013.01); *F04D 29/4213* (2013.01);
(Continued)

(58) Field of Classification Search
CPC ..... F04D 17/00; F04D 17/06; F04D 17/08; F04D 29/281; F04D 29/4206;
(Continued)

(56) References Cited

U.S. PATENT DOCUMENTS 3,481,530 A * 12/1969 Korovkin ..... F04D 17/04 415/53.2
3,794,439 A * 2/1974 Haase ..... F04D 29/4226 415/53.1
(Continued)

FOREIGN PATENT DOCUMENTS

CN 1991183 7/2007
CN 101033756 9/2007
(Continued)

OTHER PUBLICATIONS

English Translation of Chinese Search Report dated Feb. 28, 2015 for the related Chinese Patent Application No. 201180056376.9.
(Continued)

*Primary Examiner* — John K Fristoe, Jr.
*Assistant Examiner* — Julian Getachew
(74) *Attorney, Agent, or Firm* — Panasonic IP Management; Kerry S. Culpepper

(57) ABSTRACT

A centrifugal fan includes a casing side plate with a casing inlet, a spiral scroll, a tongue, a casing outlet, a main plate, a retaining ring, multiple blades arranged between the main plate and the retaining ring, and an air-intake space surrounded by the blades. The centrifugal fan further includes an airflow accelerator in the air-intake space for increasing an airflow speed of a gas toward the blades.

8 Claims, 9 Drawing Sheets

(52) U.S. Cl.
CPC ..... *F04D 29/4226* (2013.01); *F04D 29/441* (2013.01); *F05D 2250/51* (2013.01)

(58) Field of Classification Search
CPC .... F04D 29/4226; F04D 29/441; F04D 29/22; F04D 29/42; F04D 29/4213; F04D 29/422; F04D 29/426; F04D 29/428; F04D 29/44; F04D 29/445
USPC ..... 415/53.2
See application file for complete search history.

(56) References Cited

U.S. PATENT DOCUMENTS 3,796,511 A * 3/1974 Hansen ..... F04D 29/701 415/144
4,352,635 A * 10/1982 Saunders ..... F01P 5/04 236/1 EA
4,508,486 A * 4/1985 Tinker ..... F04D 29/664 415/119
4,573,869 A * 3/1986 Kitamoto ..... F04D 29/424 415/119
4,680,006 A * 7/1987 Fisher ..... F23D 11/001 415/119
5,299,634 A 4/1994 Toyoda et al.
5,570,996 A * 11/1996 Smiley, III ..... F04D 29/4226 415/204
2007/0147995 A1 6/2007 Araki
2007/0212218 A1 9/2007 Seki et al.

FOREIGN PATENT DOCUMENTS

JP 48-064811 U 8/1973
JP 58-167798 U 11/1983
JP 5-005233 1/1993
JP 5-039800 2/1993
JP 5-248397 9/1993
JP 2000-186839 7/2000
JP 2008-075658 4/2008

OTHER PUBLICATIONS

International Search Report of PCT Application No. PCT/JP2011/006012 dated Jan. 24, 2012.

* cited by examiner (a) No airflow accelerator + No impeller coating
(b) Airflow accelerator + No impeller coating
(c) Airflow accelerator + Oil-repellent coating of impeller

CENTRIFUGAL FAN AND FAN WITH SOUND-MUFFLING BOX HAVING THE CENTRIFUGAL FAN BUILT-IN

CROSS REFERENCE TO RELATED APPLICATIONS

The present application is a national phase application of international application PCT/JP2011/006012 filed on Oct. 27, 2011, and claims foreign priority to Japanese patent application JP 2010-263374 filed on Nov. 26, 2010, the contents of which are incorporated herein by reference.

TECHNICAL FIELD

The present invention relates to a centrifugal fan and a fan with a sound-muffling box having the centrifugal fan built-in.

BACKGROUND ART

In a fan feeding air by rotation of impeller, dust in the air may touch and attach to blades of the impeller. In particular, a sirocco fan has a narrow space between blades, and thus attachment and accumulation of dust result in degradation of its performance.

(Prior Art 1)

To solve this disadvantage, an adsorption net is provided ahead of airflow of the impeller in a centrifugal fan built in a spinning machine to reduce dust touching the impeller. The impeller is periodically rotated backwards to remove dust. (For example, see PTL1.)

The centrifugal fan in PTL 1 is described below with reference to FIG. 7, which is a side view of a conventional centrifugal fan built in a spinning machine.

As shown in FIG. 7, adsorption net 103 is disposed at the side of intake airflow 102 of duct 101. Air outlet 106 is formed at the blowing side of guide plate 105 covering impeller 104 inside duct 101. When impeller 104 is operated in positive rotation direction 107, adsorption net 103 removes coarse dust 108. However, fine dust 109 that cannot be removed by adsorption net 103 accumulates on impeller 104. After fine dust 109 accumulates up to a predetermined level, impeller 104 is operated in inverse rotation direction 110. As a result, airflow colliding with blade 111 changes, and accumulated fine dust 109 comes off.

(Prior Art 2)

In a centrifugal fan built in a range hood, the rotation speed of the impeller is increased for a predetermined time after the normal operation, so as to remove accumulated oil. (For example, see PTL2.)

The centrifugal fan in PTL2 is described below with reference to FIG. 8 that is a side view of a conventional centrifugal fan built in a range hood.

As shown in FIG. 8, purifier 203 is provided on intake passage 202 of hood housing 201. Vent 206 is formed on the blowing side of fan case 205 covering impeller 204 inside hood housing 201. When impeller 204 is under normal operation, purifier 203 partially removes oil 207 drawn in from intake passage 202. A portion of oil 208 not removed by purifier 203 accumulates on impeller 204. After the normal operation that causes accumulation of oil 208 on impeller 204, the rotation speed of impeller 204 is increased for a predetermined time. As a result, the speed of airflow colliding with blades 209 of impeller 204 increases, and thus accumulated oil 208 comes off.

(Prior Art 3)

In a centrifugal fan built in a ceiling of a rail car, a rotary brush slidably blows air to the impeller. (For example, see PTL3.)

The centrifugal fan in PTL3 is described below with reference to FIG. 9 that is a side view of a conventional centrifugal fan built in a ceiling of a rail car.

As shown in FIG. 9, impeller 302 is disposed in wind-direction flap 301. Rotary brush 303 rotates and slidably contacts impeller 302 via an opening in a part of wind-direction flap 301. In addition, air 305 from air nozzle 304 collides with impeller 302 via the opening in a part of wind-direction flap 301. The operation of impeller 302 is stopped for cleaning, and rotary brush 303 and air 305 remove dust 306 accumulated during the normal operation of impeller 302.

However, in the aforementioned centrifugal fans, dust naturally accumulates more easily on the impeller if the centrifugal fan is operated under dusty environment. Rotation of impeller to which dust is attached becomes imbalanced, resulting in damage to the impeller. Therefore, the operation in inverse rotation, operation at increased rotation speed, or cleaning operation is frequently executed for maintenance.

CITATION LIST

Patent Literature

PTL1 Japanese Patent Unexamined Publication No. H5-5233

PTL2 Japanese Patent Unexamined Publication No. 2000-186839

PTL3 Japanese Patent Unexamined Publication No. H5-39800

SUMMARY OF THE INVENTION

In a centrifugal fan of the present invention, an impeller is disposed inside a fan casing. The fan casing includes a casing side plate with a casing inlet for taking in a gas, a spiral scroll, a tongue, and a casing outlet. The impeller includes a main plate fixed to a rotating shaft that transmits rotation of a motor, a retaining ring disposed facing the main plate, and multiple blades arranged between the main plate and the retaining ring. The centrifugal fan takes in the gas from the casing inlet by rotating the impeller. The gas is then passed through an air-intake space surrounded by the blades and between the blades, and discharged from the casing outlet. An airflow accelerator for increasing the airflow speed of the gas toward the blades is provided in the air-intake space.

In this structure, the airflow accelerator blocks part of airflow from the side of rotating shaft to the blades. This makes the airflow around the airflow accelerator partially deflect while increasing the speed. Therefore, dust attached to inner faces of the blades while the impeller rotates is blown off by accelerated airflow passing near the airflow accelerator. As a result, accumulation of dust on the blades is suppressed, and a long maintenance cycle is achieved.

DESCRIPTION OF EMBODIMENT

An exemplary embodiment of the present invention is described below with reference to drawings.

Exemplary Embodiment

Figure 1:
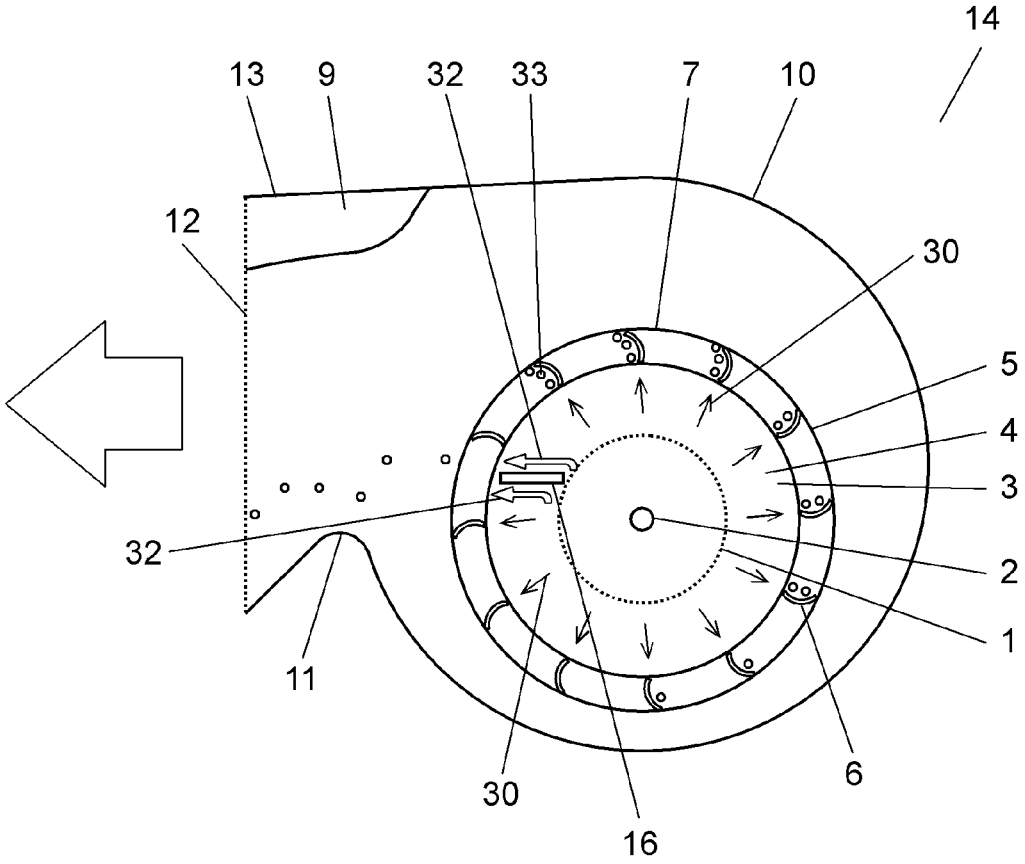
FIG. 1 is a side view of a centrifugal fan in accordance with an exemplary embodiment of the present invention.
Figure 2:
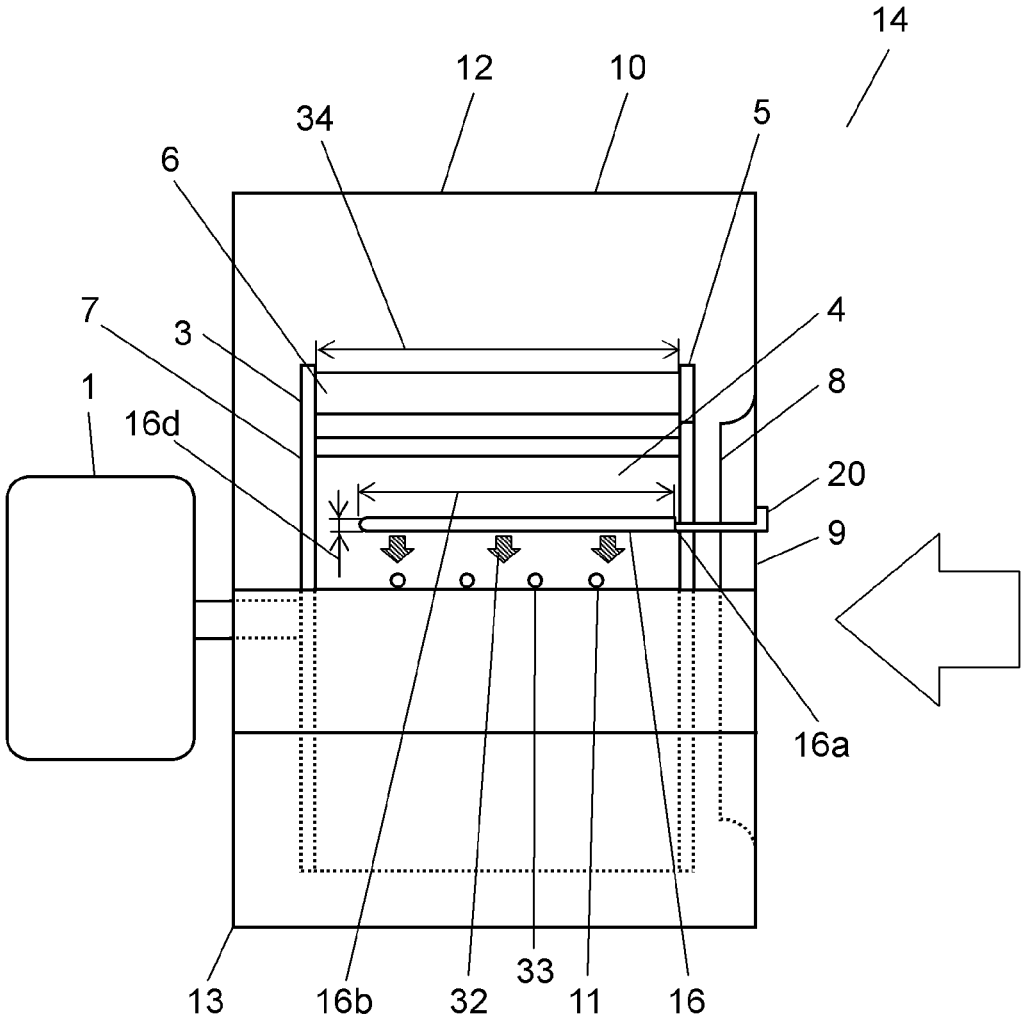
FIG. 2 is a front view of the centrifugal fan.

FIG. 1 is a side view of a centrifugal fan in the exemplary embodiment of the present invention. FIG. 2 is a front view of the centrifugal fan. As shown in FIGS. 1 and 2, centrifugal fan 14 has impeller 7 inside fan casing 13. Fan casing 13 includes casing side plate 9 with casing inlet 8 for taking in a gas, spiral scroll 10, tongue 11, and casing outlet 12. The gas in this exemplary embodiment of the present invention is air.

Impeller 7 includes main plate 3 fixed to rotating shaft 2 that transmits rotation of motor 1, retaining ring 5 disposed facing main plate 3, and multiple blades 6 arranged between main plate 3 and retaining ring 5.

The gas is taken in from casing inlet 8 by rotating impeller 7. Then, the gas is passed through an air-intake space 4 surrounded by blades 6 and between blades 6, and discharged from casing outlet 12.

Airflow accelerator 16 for increasing the airflow speed of the gas toward blades 6 is provided in air-intake space 4. Airflow accelerator 16 is inserted into air-intake space 4 from the side of casing inlet 8, and is fixed at a predetermined position. In other words, airflow accelerator 16 stays at the predetermined position even when impeller 7 rotates.

Figure 3:
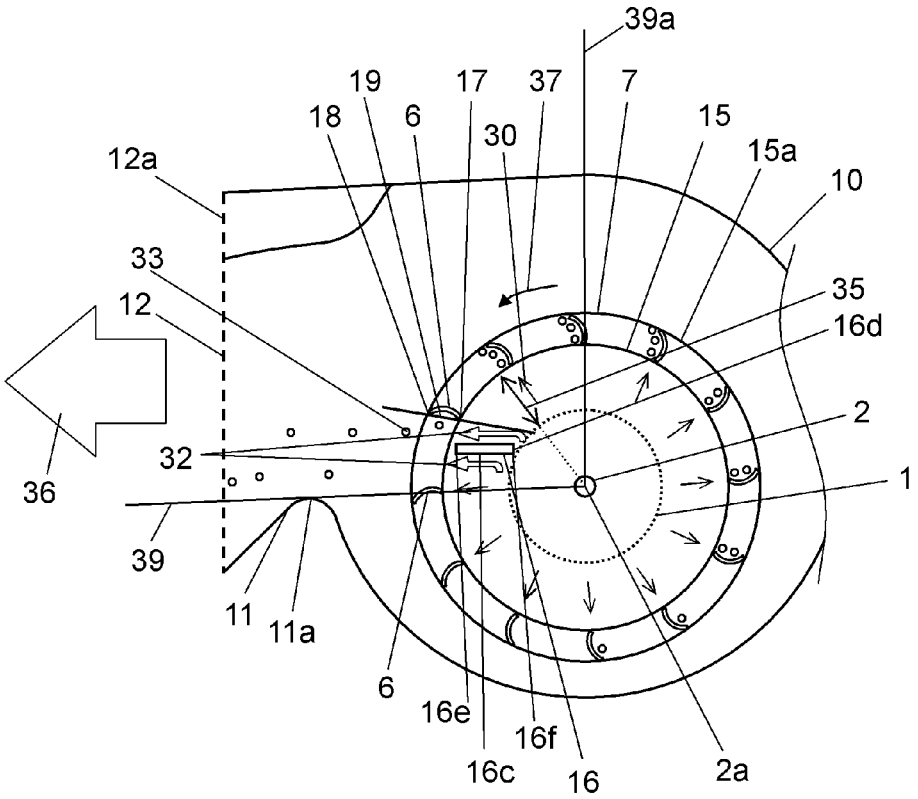
FIG. 3 is a side view illustrating a position of an airflow accelerator of the centrifugal fan.

FIG. 3 is a side view illustrating a position of the airflow accelerator of the centrifugal fan in the exemplary embodiment of the present invention. Airflow accelerator 16 is a sheet of thin plate. Airflow accelerator 16 has first side 16*b*, shown in FIG. 2, whose length is shorter than distance 34 from main plate 3 to retaining ring 5; second side 16*c*, shown in FIG. 3, whose length is shorter than distance 35 from motor 1 to blade 6 with respect to a direction of airflow towards an outer periphery 15*a* of impeller 7; and third side 16*d*, shown in FIG. 2, perpendicular to first side 16*b* and second side 16*c*. First side 16*b* is disposed perpendicular to main plate 3. First side 16*b* and second side 16*c* are nearly orthogonal. As shown in FIG. 3, end 16*e* of the second side at the blade side is disposed ahead end 16*f* of the second side at the motor side relative to rotating direction 37 of impeller 7.

Also as shown in FIG. 2, end 16*a* of airflow accelerator 16 at the side of casing side plate is attached to fan casing 13 via attachment member 20 provided on casing side plate 9, so as to integrate airflow accelerator 16 with fan casing 13 using a simple structure.

With the above structure, as shown in FIG. 3, airflow accelerator 16 blocks part of airflow 30 from the side of rotating shaft 2 toward blades 6. As a result, airflow 30 toward outer periphery 15*a* of impeller 7 is bent frontward in rotating direction 37 of impeller 7. This creates an area with low wind speed at the back of rotating direction 37 of impeller 37 relative to airflow accelerator 16. In addition, accelerated deflecting airflow 32 with high wind speed is generated along a face formed by first side 16*b* and second side 16*c* of airflow accelerator 16. In other words, in the extended direction of second side 16*c* of airflow accelerator 16, airflow 30 is collected along the face formed by first side 16*b* and second side 16*c* of airflow accelerator 16, and its wind speed is accelerated. This accelerated deflecting airflow 32 blows off dust 33 attached to inner faces of blades 6 during rotation of impeller 7.

Airflow accelerator 16 in FIG. 3 is preferably disposed such that its second side 16*c* can be positioned on straight line 19 connecting airflow inlet end 17 of blade 6 at inner periphery 15 of impeller 7 and airflow outlet end 18 of blade 6 at outer periphery 15*a* of impeller 7.

In this structure, accelerated deflecting airflow 32 that is accelerated and deflected by airflow accelerator 16 passes more easily between blades 6 toward outer periphery 15*a* of impeller 7. Therefore, accelerated deflecting airflow 32 retains its high speed when passing between blades 6. Accordingly, dust 33 attached to the inner face of each of blades 6 is efficiently blown off.

In addition, as shown in FIG. 3, airflow accelerator 16 is preferably disposed between line 39 connecting tongue tip 11*a* of tongue 11 and rotation center 2*a* of rotating shaft 2 and line 39*a* extended from rotation center 2 parallel to face 12*a* formed by casing outlet 12*a* when impeller 7 rotates toward tongue 11 as rotating direction 37. In the space inside scroll 10, wind volume is the least in an area just ahead tongue 11 relative to rotating direction 37. Airflow accelerator 16 is not disposed such that accelerated deflecting airflow 32 is directed to this area where the wind volume is small. Airflow accelerator 16 can efficiently blow off dust 33 by disposing it such that accelerated deflecting airflow 32 is directed to an area where large wind volume passes between blades, i.e., at the back of tongue 11 relative to rotating direction 37.

An angle formed by accelerated deflecting airflow 32 and airflow 36 at casing outlet 12 is set to less than 90°, so as to discharge blown-off dust 33 outside casing outlet 12. Further, accelerated deflecting airflow 32 is preferably set not to collide with an inner wall face of scroll 10. In other words, the wind direction of accelerated deflecting airflow 32 is adjusted to a direction almost same as the wind direction of airflow 36 at casing outlet 12.

Figure 4A:
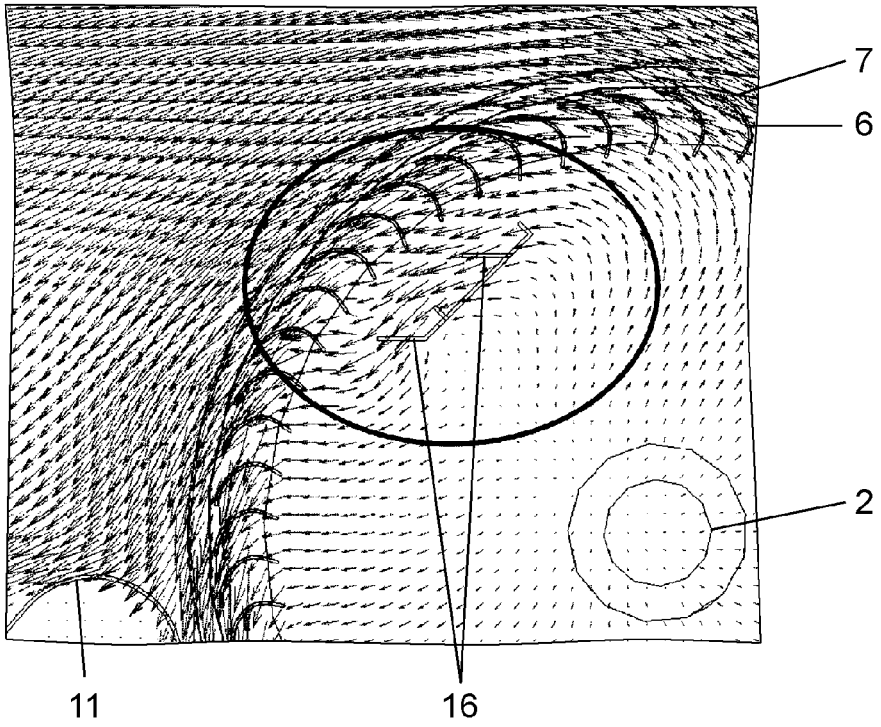
FIG. 4A is an airflow simulation chart of the centrifugal fan.
Figure 4B:
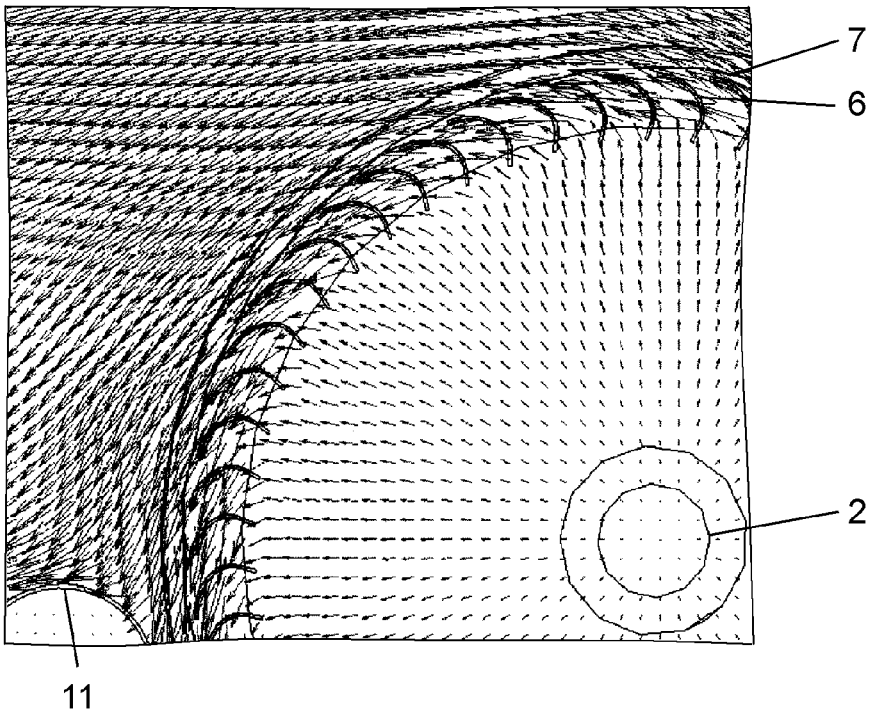
FIG. 4B is an airflow simulation chart when the airflow accelerator of the centrifugal fan is not used.

Next, airflow is simulated to confirm the effect of airflow accelerator 16, using airflow vector representation indicating wind speed and wind direction. FIG. 4A is an airflow simulation chart of the centrifugal fan in the exemplary embodiment of the present invention. FIG. 4B is an airflow simulation chart of the centrifugal fan without airflow accelerator. In FIGS. 4A and 4B, a direction of an arrow represents the wind direction, and a length of an arrow represents the wind speed. As shown in FIG. 4A, the wind direction near airflow accelerator 16 is bent along the face of airflow accelerator 16 when airflow accelerator 16 is used. The wind speed is also increased. On the other hand, when airflow accelerator 16 is not used, the airflow enters blades 6 almost evenly.

The length of first side 16*b* of airflow accelerator 16 shown in FIG. 2 is set such that accelerated deflecting airflow 32 is applied to entire blade 6, corresponding to distance 34 of blade 6 from main plate 3 to retaining ring 5. Or, small airflow accelerator 16 may be provided only at the side of main plate 3 where dust 33 likely attaches. Smaller airflow accelerator 16 can suppress the increase of pressure loss.

In this exemplary embodiment, airflow accelerator 16 is a thin plate. However, as long as airflow accelerator 16 is effective in bending airflow 30 toward outer periphery 15*a*, other shapes are also applicable. For example, the same effect is achievable by using a prismatic material with triangular cross-section, or a plate with wing-like cross-section. A planar shape of airflow accelerator 16 where airflow 30 contacts may also be, for example, oval.

Further, as long as airflow accelerator 16 has a structure that it can be fixed at a predetermined position relative to blade 6, airflow accelerator 16 does not have to be attached to casing side plate 9. For example, in the case of fan with sound-muffling box, which is described later, airflow accelerator 16 may be attached to an inner face of a housing an attachment member.

Figure 5:
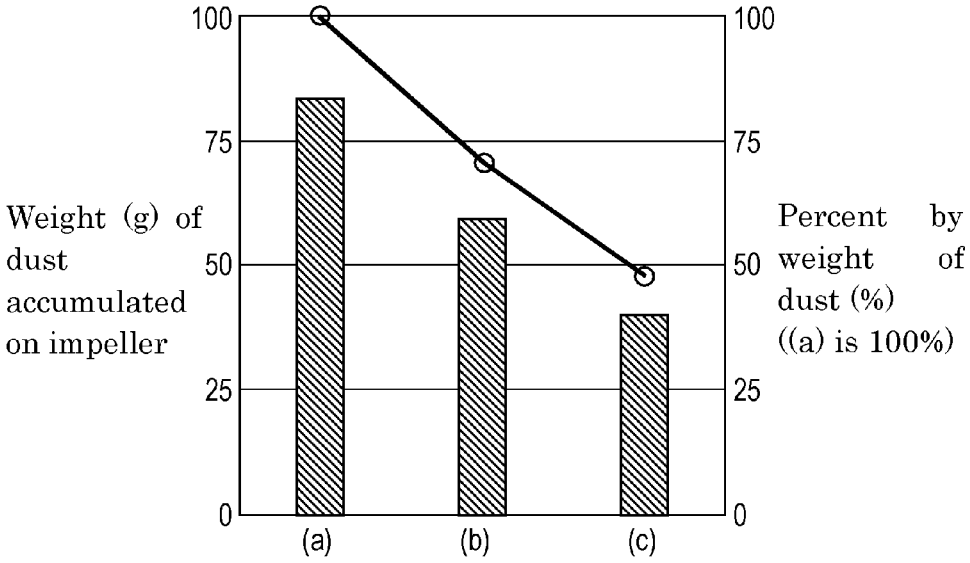
FIG. 5 is a graph comparing weight of dust accumulated on an impeller in an accelerated dust adherence test of the centrifugal fan.

Next are described results of accelerated dust adherence test of centrifugal fan 14 in the exemplary embodiment and the conventional centrifugal fan. FIG. 5 is a graph comparing weight of dust accumulated on the impeller of the centrifugal fan in the exemplary embodiment in the accelerated dust adherence test. In FIG. 5, impeller in (a) is the conventional centrifugal fan without airflow accelerator and coating. Impeller 7 in (b) is centrifugal fan 14 using airflow accelerator 16 in the exemplary embodiment without coating. Impeller 7 in (c) is centrifugal fan 14 using airflow accelerator 16 in the exemplary embodiment with oil-repellent coating. In this accelerated dust adherence test, predetermined dust 33 is drawn into the centrifugal fan in operation, and weight of dust 33 attached to blades 6 is compared. In comparison of conventional centrifugal fan (a) and centrifugal fan (b) in this exemplary embodiment using airflow accelerator 16, weight of dust 33 accumulated on blade 6 is 84 g in (a) and 59 g in (b). Reduction by about 30% is confirmed. In centrifugal fan (c) in which oil-repellent coating is applied to impeller 7, weight of accumulated dust 33 is 40 g. This is because oil-repellent coating makes dust 33 easily removable, and thus the effect of airflow accelerator 16 is enhanced.

Impeller 7 used for airflow simulation and accelerated dust adherence test is a double-suction impeller directly connected to and driven by motor 1. The double-suction impeller has blade 6 with outer dimension of 246 mm, blade length of 132 mm at an opposite side of motor, blade length of 88 mm at the motor side, blade outlet angle of 174°, and blade chord length of 18.5 mm. Motor 1 with four poles and outer dimension of 160 mm is disposed. At the blade side opposite to the motor, two airflow accelerators 16 whose first side 16*b* in the direction of rotation center 2*a* of rotating shaft 2 is 95 mm long and second side 16*c* is 13 mm long are disposed 15 mm apart in the direction from blade 6 to rotating shaft 2. In the accelerated dust adherence test, 200 g of dust that is a mixture of silica sand, carbon black, loamy layer of the Kanto Plain, and cotton lint is fed at a predetermined time interval. The centrifugal fan is operated for 150 minutes in total.

As described above, accumulation of dust 33 on blades 6 is suppressed in centrifugal fan 14 with airflow accelerator 16 in the exemplary embodiment of the present invention. Accordingly, a longer maintenance cycle is achieved.

To achieve a long maintenance cycle, depending on the purpose of use of centrifugal fan 14, dust attachment can be further effectively suppressed by increasing the area and the number of airflow accelerators 16.

Figure 6:
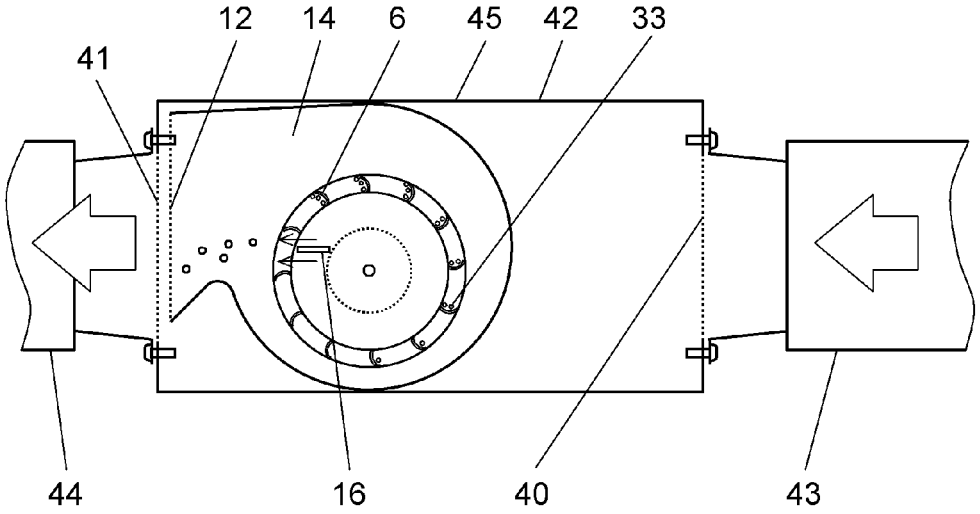
FIG. 6 is a side view of a fan with sound-muffling box equipped with the centrifugal fan.
Figure 7:
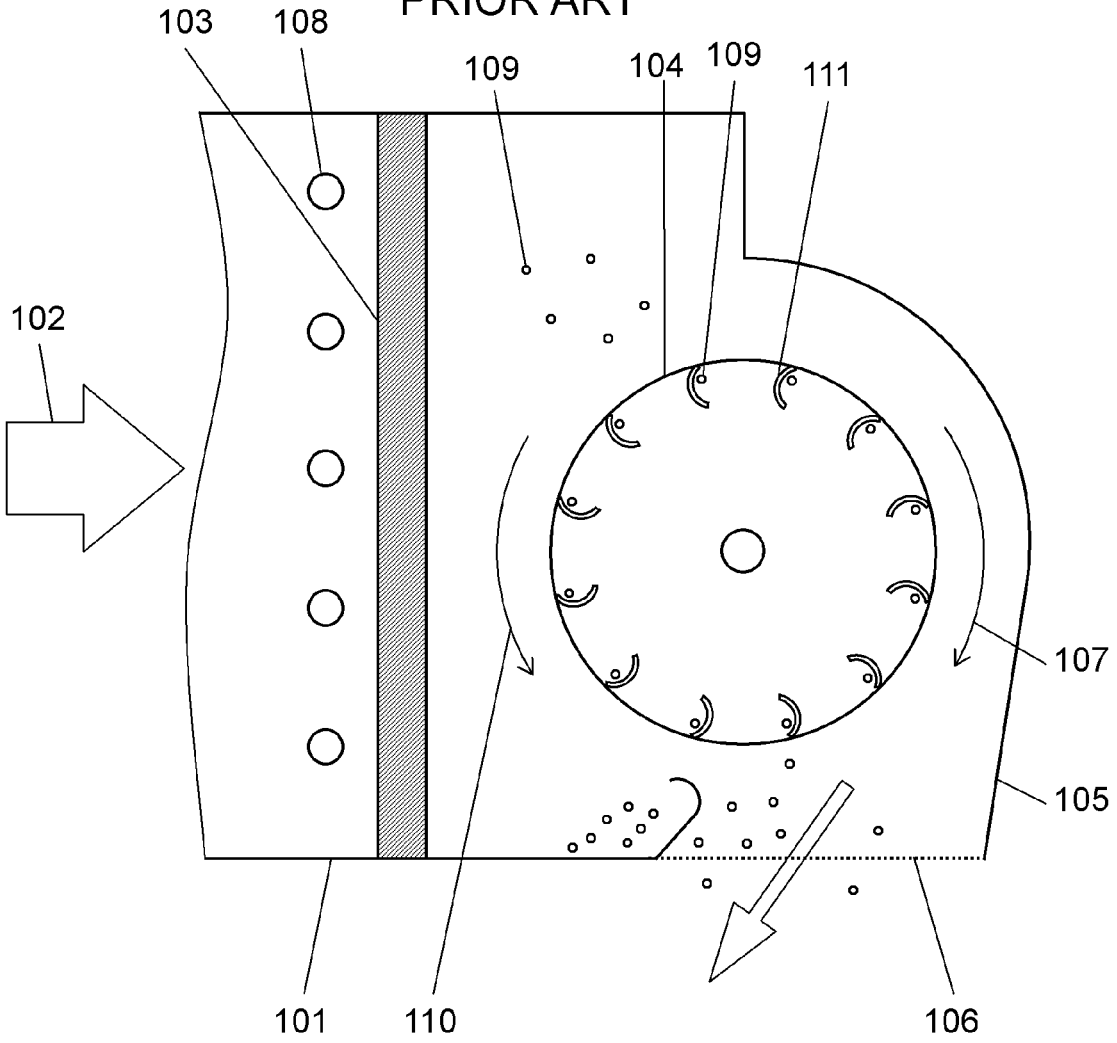
FIG. 7 PRIOR ART
FIG. 7 is a side view of a conventional centrifugal fan built in a spinning machine.
Figure 8:
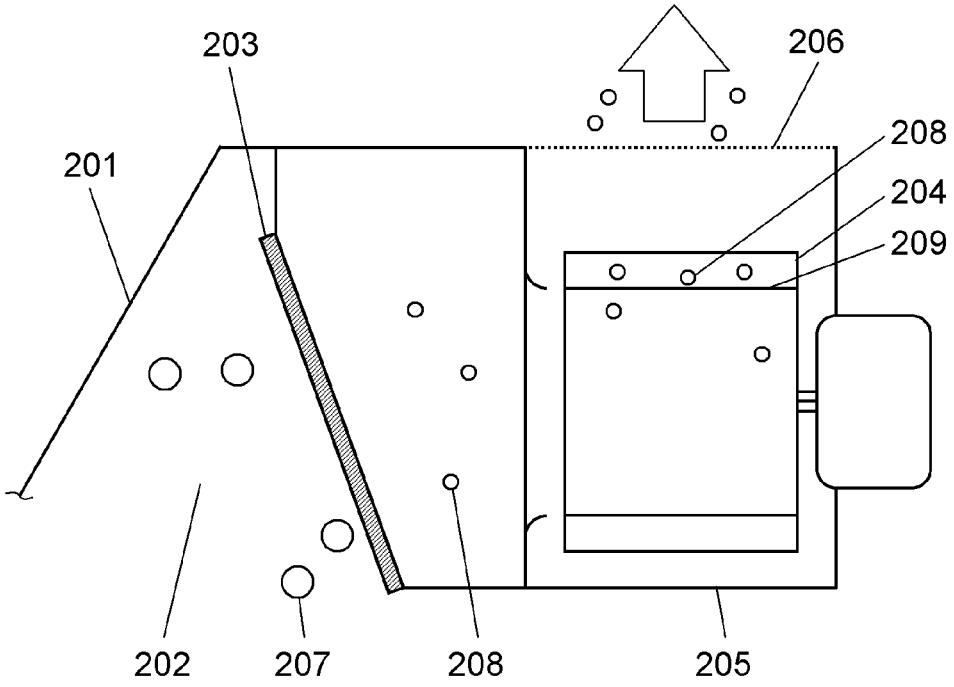
FIG. 8 PRIOR ART
FIG. 8 is a side view of the centrifugal fan built in a range hood.
Figure 9:
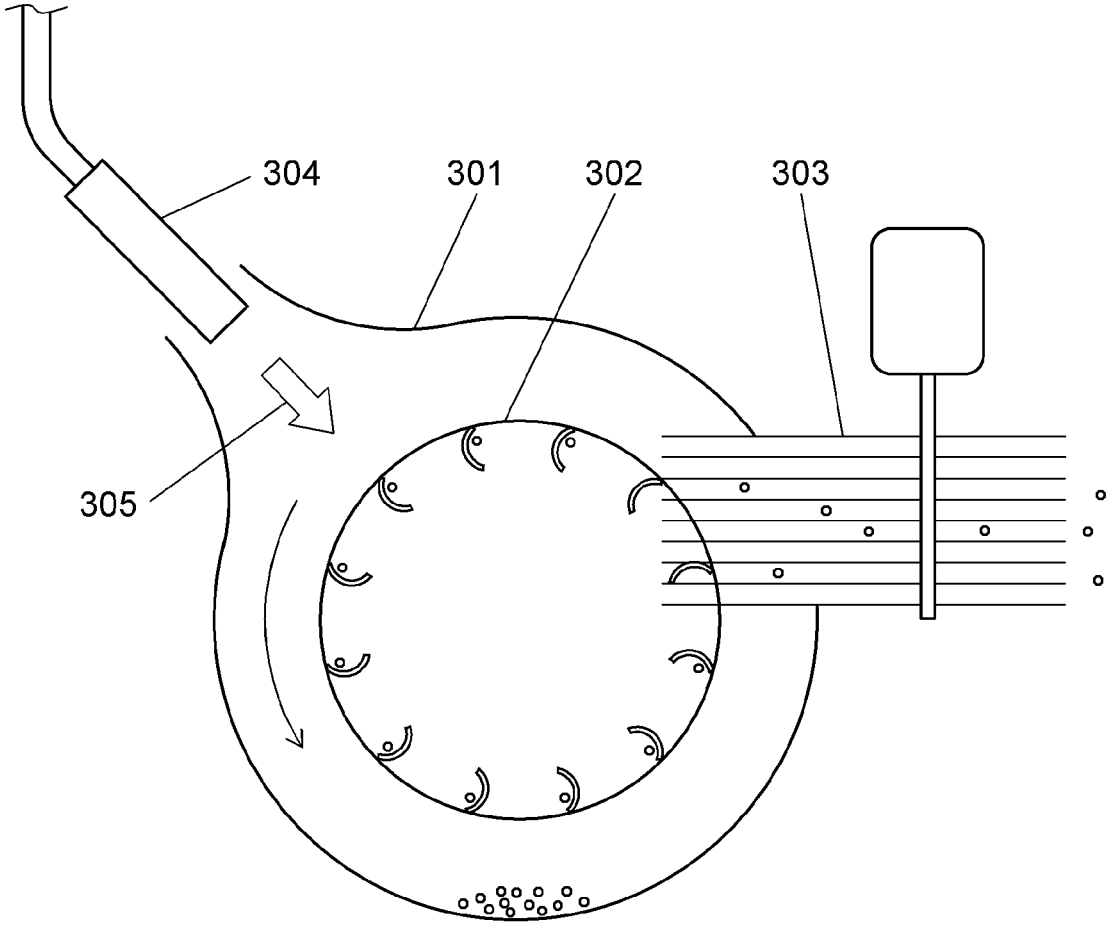
FIG. 9 PRIOR ART
FIG. 9 is a side view of the centrifugal fan built in a ceiling of a rail car.

FIG. 6 is a side view of a fan with sound-muffling box equipped with the centrifugal fan in the exemplary embodiment of the present invention. FIG. 6 illustrates fan with sound-muffling box 45 equipped with centrifugal fan 14 using airflow accelerator 16. Fan with sound-muffling box 45 includes centrifugal fan 14 inside box housing 42 on which housing inlet 40 and housing outlet 41 are provided. Centrifugal fan 14 is disposed such that its casing outlet 12 faces housing outlet 41. Also in centrifugal fan 14, inlet duct 43 is connected to housing inlet 40, and outlet duct 44 is connected to housing outlet 41.

In this type of fan with sound-muffling box 45, frequent checking is difficult because centrifugal fan 14 is hidden inside housing 42. However, since airflow accelerator 16 effectively blows off dust 33 attached to the inner faces of blades 6, a long maintenance cycle can be set.

Furthermore, in fan with sound-muffling box 45, a sound-muffling material (not illustrated) is attached inside housing 42. This reduces leaking of noise generated by centrifugal fan 14 to outside. Accordingly, a large wind volume can be output without making large noise even if centrifugal fan 14 with large rated wind volume is used. Aforementioned airflow accelerator 16 is appropriate for such centrifugal fan 14 with large wind volume. Attachment of dust 33 can be further suppressed by making fast airflow collide with blades 6.

INDUSTRIAL APPLICABILITY

The centrifugal fan of the present invention can be used for cooling equipment by the use of its exhaust structure in addition to the purpose of carrying air, such as ventilators and fans. Accordingly, the present invention is also applicable to fans in compact equipment.

REFERENCE MARKS IN THE DRAWINGS

1 Motor
2 Rotating shaft
2*a* Rotation center
3 Main plate
4 Air-intake space
5 Retaining ring
6 Blade
7 Impeller
8 Casing inlet
9 Casing side plate
10 Scroll
11 Tongue
11*a* Tongue tip
12 Casing outlet
12*a* Face formed by casing outlet
13 Fan casing
14 Centrifugal fan
15 Inner periphery
15*a* Outer periphery
16 Airflow accelerator
16*a* End at the side of casing side plate
16*b* First side
16*c* Second side
16*d* Third side
16*e* End of second side at the blade side
16*f* End of second side at the motor side
17 Airflow inlet end
18 Airflow outlet end

19 Straight line
20 Attachment member
30 Airflow
32 Accelerated deflecting airflow
33 Dust
34 Distance from main plate to retaining ring
35 Distance from motor to blade
36 Airflow at casing outlet
37 Rotating direction
39 Line connecting tongue tip and rotation center
39*a* Line extended from rotation center parallel to face formed by casing outlet
40 Housing inlet
41 Housing outlet
42 Housing
43 Inlet duct
44 Outlet duct
45 Fan with sound-muffling box

The invention claimed is:

1. A centrifugal fan in which an impeller is disposed inside a fan casing, the fan casing including a casing side plate with a casing inlet for taking in a gas, a spiral scroll, a tongue, and a casing outlet, and the impeller including a main plate fixed to a rotating shaft that transmits rotation of a motor, a retaining ring disposed facing the main plate, and a plurality of blades arranged between the main plate and the retaining ring, wherein the centrifugal fan takes in the gas from the casing inlet, passes the gas through an air-intake space surrounded by the blades and between the blades, and discharges the gas from the casing outlet by rotating the impeller, the centrifugal fan further includes an airflow accelerator in the air-intake space for increasing an airflow speed of the gas toward the blades, the airflow accelerator is a thin plate including a first side whose length is shorter than a distance from the main plate to the retaining ring, a second side whose length is shorter than a distance from a circumferential plane extending from a radially outermost periphery of the motor to the blades, and a third side perpendicular to the first side and the second side, a line aligned with the second side of the airflow accelerator and projecting from an end of the airflow accelerator intersects a face formed by the casing outlet at a substantially orthogonal angle, and the face is a plane connecting outlet ends of the tongue and the scroll at the casing outlet.

2. The centrifugal fan of claim 1, wherein:

the first side is perpendicular to the main plate; and an end of the second side at a blade side is disposed ahead of an end of the second side at a motor side relative to a rotating direction of the impeller.

3. The centrifugal fan of claim 2, wherein the airflow accelerator is disposed such that the second side is positioned on a straight line connecting an airflow inlet end of one of the blades at an inner periphery of the impeller and an airflow outlet end of said one of the blades at an outer periphery of the impeller.

4. The centrifugal fan of claim 2, wherein the airflow accelerator is disposed between a line connecting a tip of the tongue and a rotation center of the rotating shaft and a line extended from the rotation center parallel to a face formed by the casing outlet when the impeller rotates toward the tongue as the rotating direction.

5. The centrifugal fan of claim 1, wherein the centrifugal fan is a sirocco fan, and an end of the airflow accelerator at a side of the casing side plate is fixed to the casing side plate.

6. A fan housing with a sound-muffling box in which a centrifugal fan is built in a box housing provided with a housing inlet and a housing outlet, in the centrifugal fan, an impeller is disposed inside a fan casing, the fan casing including a casing side plate with a casing inlet for taking in a gas, a spiral scroll, a tongue, and a casing outlet, and the impeller including a main plate fixed to a rotating shaft that transmits rotation of a motor, a retaining ring disposed facing the main plate, and a plurality of blades arranged between the main plate and the retaining ring, wherein the centrifugal fan takes in the gas from the casing inlet, passes the gas through an air-intake space surrounded by the blades and between the blades, and discharges the gas from the casing outlet by rotating the impeller, the centrifugal fan further includes an airflow accelerator in the air-intake space for increasing an airflow speed of the gas toward the blades, the airflow accelerator is a thin plate including a first side whose length is shorter than a distance from the main plate to the retaining ring, a second side whose length is shorter than a distance from a circumferential plane extending from a radially outermost periphery of the motor to the blades, and a third side perpendicular to the first side and the second side, a line aligned with the second side of the airflow accelerator and projecting from an end of the airflow accelerator intersects a face formed by the casing outlet at a substantially orthogonal angle, and the face is a plane connecting outlet ends of the tongue and the scroll at the casing outlet.

7. The fan housing of claim 6, wherein the length of the first side of the airflow accelerator is set such that during fan operation accelerated deflecting airflow is applied to an entire blade of the plurality of blades, corresponding to a distance of the entire blade from the main plate to the retaining ring.

8. The fan of claim 1, wherein the length of the first side of the airflow accelerator is set such that during fan operation accelerated deflecting airflow is applied to an entire blade of the plurality of blades, corresponding to a distance of the entire blade from the main plate to the retaining ring.

* * * * *